US011197114B2

(12) United States Patent
Tam

(10) Patent No.: US 11,197,114 B2
(45) Date of Patent: Dec. 7, 2021

(54) EXTENDED COGNITIVE LOUDSPEAKER SYSTEM (CLS)

(71) Applicant: Kit S. Tam, Menlo Park, CA (US)

(72) Inventor: Kit S. Tam, Menlo Park, CA (US)

( * ) Notice: Subject to any disclaimer, the term of this patent is extended or adjusted under 35 U.S.C. 154(b) by 0 days.

(21) Appl. No.: 17/101,348

(22) Filed: Nov. 23, 2020

(65) Prior Publication Data

US 2021/0160639 A1 May 27, 2021

Related U.S. Application Data

(60) Provisional application No. 62/941,571, filed on Nov. 27, 2019.

(51) Int. Cl.
*H04S 3/00* (2006.01)

(52) U.S. Cl.
CPC ..... *H04S 3/008* (2013.01); *H04R 2227/005* (2013.01); *H04R 2420/07* (2013.01)

(58) Field of Classification Search
CPC ... H04S 3/00; H04S 2400/11; H04R 2400/11; H04R 2227/005
USPC ..... 700/94
See application file for complete search history.

(56) References Cited

U.S. PATENT DOCUMENTS

| | | | |
|---|---|---|---|
| 6,094,671 | A | 7/2000 | Chase et al. |
| RE38,405 | E | 1/2004 | Clair, Jr. et al. |
| 6,757,517 | B2 | 6/2004 | Chang |
| 7,539,219 | B2 | 5/2009 | Kwong et al. |
| 7,684,377 | B2 | 3/2010 | Lee et al. |
| 7,702,403 | B1 | 4/2010 | Gladwin et al. |
| 7,805,210 | B2 | 9/2010 | Cucos et al. |
| 7,940,667 | B1 | 5/2011 | Coady et al. |

(Continued)

FOREIGN PATENT DOCUMENTS

| | | | |
|---|---|---|---|
| JP | S64-044199 | A | 2/1989 |
| JP | 2005-079614 | A | 3/2005 |

(Continued)

OTHER PUBLICATIONS

Aiello, G. Roberto and Rogerson, Gerald D., "Ultra-Wideband Wireless Systems", pp. 36-47, IEEE Microwave magazine, Jun. 2003.

(Continued)

*Primary Examiner* — Melur Ramakrishnaiah
(74) *Attorney, Agent, or Firm* — Bever, Hoffman & Harms, LLP

(57) ABSTRACT

An extended cognitive loudspeaker system (CLS) including a system manager coupled to a basic service set (BSS) of a wireless network, wherein the system manager establishes a CLS network using an independent BSS (IBSS) of the wireless network. A first CLS playgroup is formed by the system manager through the CLS network IBSS, wherein the first CLS playgroup includes a first control station (CS) and a first group of sound production stations (SPSs). A second CLS playgroup is formed by the system manager through the CLS network IBBS, wherein the second CLS playgroup includes a second CS station and a second group of SPSs. The second CLS playgroup can be dissolved, and the first CLS playgroup can be modified to include the second group of SPSs. The second group of SPSs can include mobility functions to enable any required movement of the second group of SPSs.

20 Claims, 6 Drawing Sheets

(56) References Cited

U.S. PATENT DOCUMENTS

| | | | | |
|---|---|---|---|---|
| 7,987,294 | B2 | 7/2011 | Bryce et al. | |
| 9,282,418 | B2 | 3/2016 | Tam | |
| 2001/0041588 | A1 | 11/2001 | Holstrom et al. | |
| 2002/0002039 | A1 | 1/2002 | Qureshey et al. | |
| 2002/0072816 | A1 | 6/2002 | Shdema et al. | |
| 2002/0124097 | A1 | 9/2002 | Isely | |
| 2003/0093669 | A1 | 5/2003 | Morais et al. | |
| 2003/0185542 | A1 | 10/2003 | McVeigh et al. | |
| 2005/0018780 | A1 | 1/2005 | Kim | |
| 2005/0086273 | A1 | 4/2005 | Loebbert et al. | |
| 2005/0113058 | A1 | 5/2005 | Gosieski, Jr. | |
| 2005/0177256 | A1 | 8/2005 | Shintani et al. | |
| 2005/0190928 | A1 | 9/2005 | Noto | |
| 2005/0234731 | A1 | 10/2005 | Sirivara et al. | |
| 2006/0126586 | A1 | 6/2006 | Um et al. | |
| 2007/0022207 | A1 | 1/2007 | Millington | |
| 2007/0121950 | A1 | 5/2007 | Okaue | |
| 2007/0136778 | A1 | 6/2007 | Birger et al. | |
| 2007/0214229 | A1 | 9/2007 | Millington et al. | |
| 2008/0092204 | A1 | 4/2008 | Bryce et al. | |
| 2008/0152165 | A1 | 6/2008 | Zacchi | |
| 2008/0175395 | A1 | 7/2008 | Rice | |
| 2008/0181424 | A1 | 7/2008 | Schulein et al. | |
| 2009/0164905 | A1 | 6/2009 | Ko | |
| 2009/0169030 | A1 | 7/2009 | Inohara | |
| 2009/0180465 | A1 | 7/2009 | Closset et al. | |
| 2009/0180631 | A1 | 7/2009 | Michael et al. | |
| 2009/0304194 | A1 | 12/2009 | Eggleston et al. | |
| 2010/0022183 | A1 | 1/2010 | Ryle et al. | |
| 2010/0272270 | A1 | 10/2010 | Chaikin et al. | |
| 2010/0299639 | A1* | 11/2010 | Ramsay | H04R 27/00 715/835 |
| 2011/0015769 | A1 | 1/2011 | Haatainen | |
| 2011/0270428 | A1* | 11/2011 | Tam | H04S 3/008 700/94 |
| 2014/0010515 | A1 | 1/2014 | Lee | |
| 2014/0082396 | A1 | 3/2014 | Vahidsafa et al. | |
| 2014/0156103 | A1* | 6/2014 | Feigenbaum | G05B 15/02 700/302 |
| 2014/0205126 | A1* | 7/2014 | Faranda | H04R 1/026 381/335 |
| 2014/0286507 | A1 | 9/2014 | Kallai | |
| 2015/0207877 | A1 | 7/2015 | Ito | |
| 2016/0105754 | A1* | 4/2016 | Carlsson | H04S 7/303 381/81 |
| 2017/0277507 | A1 | 9/2017 | Ando | |
| 2017/0303042 | A1* | 10/2017 | Hammer | H04R 3/12 |
| 2017/0318068 | A1 | 11/2017 | Kikkerishivadatta | |
| 2018/0012631 | A1 | 1/2018 | Moller | |
| 2018/0234936 | A1 | 8/2018 | Crowe et al. | |
| 2018/0246524 | A1* | 8/2018 | Hillen | B25J 9/1664 |
| 2018/0359691 | A1* | 12/2018 | Young | H04R 3/12 |
| 2019/0354338 | A1 | 11/2019 | Coburn, IV | |
| 2019/0354339 | A1 | 11/2019 | Coburn, IV | |
| 2020/0022100 | A1 | 1/2020 | Simon | |
| 2021/0065720 | A1 | 3/2021 | Dewey | |
| 2021/0075533 | A1 | 3/2021 | Tam | |
| 2021/0092520 | A1 | 3/2021 | Tam | |

FOREIGN PATENT DOCUMENTS

| | | | |
|---|---|---|---|
| JP | 2010-056970 | A | 3/2010 |
| KR | 20010044634 | A | 6/2001 |
| WO | 2004/034602 | A1 | 4/2004 |
| WO | 2008/103091 | A1 | 8/2008 |
| WO | 2008/113053 | A1 | 9/2008 |
| WO | 2009/112070 | A1 | 9/2009 |

OTHER PUBLICATIONS

Geer, David, "UWB Standardization Effort Ends in Controversy", pp. 13-16, IEEE Computer Society, Jul. 2006.

Mercier, Patrick P., et al., "An Energy-Efficient All-Digital UWB Transmitter Employing Dual Capacitively-Couple Pulse-Shaping Drivers", pp. 1679-1688, IEEE Journal of Solid-State Circuits, vol. 44, No. 6, Jun. 6, 2009.

Ultralink/XLO Products, Inc.,"Argentum Accourtics Cables by Ultralink/XLO at CES 2009", 2 pages, Jan. 14, 2009.

Stadius, Kari et al., "Multitone Fast Frequency-Hopping Synthesizer for UWB Radio", pp. 1633-1641, IEEE Transactions On Microwave Theory And Techniques, vol. 55, No. 8, Aug. 2007.

Pioneer Electronics U.S.A., Elite SC-27 "7.1-Channel A/V Receiver Featuring ICEpower Class-D Amplification . . . " brochure, 2 pages, 2009.

Roy, Sumit et al., "Ultrawideband Radio Design: The Promise of High-Speed, Short-Range Wireless Connectivity", pp. 295-311, Proceedings of The IEEE, vol. 92, No. 2, Feb. 2004.

Linksys by Cisco brochure entitled "Introducing Wireless Home Audio", 7 pages, date unknown.

Yamaha MusicCAST2 MCX-RC100 and MCX-A300/MCX-P200 Owner's Manual, 20 pages, 2009.

Yamaha DME Manual; copyright 2004.

ID3 Draft specification; copyright 1968.

* cited by examiner

EXTENDED COGNITIVE LOUDSPEAKER SYSTEM (CLS)

RELATED APPLICATION

This application claims priority from U.S. Provisional Patent Application 62/941,571, entitled "Extended Cognitive Loudspeaker System (CLS)", which was filed on Nov. 27, 2019, and is incorporated by reference herein.

FIELD OF THE INVENTION

The present invention relates to an extended cognitive loudspeaker system capable of repurposing wireless sound production stations into various playgroups, and methods for implementing the same.

RELATED ART

Sound reproduction is a very important function for home living. Various appliances are available to provide common sound reproduction functions. For example, HDTV sets, sound bars, surround sound systems and subwoofers are used for watching movies and television shows. High end loudspeakers and associated components, such as source components, a turntable and amplifiers, are used for high fidelity music audition. Computer connected loudspeakers are used for electronic gaming. Smart speakers and streaming devices such as smart phones, PCs and music servers are used for background music from audio streaming. Smart speakers, which implement smart home services (such as Alexa from Amazon), are used for voice-based internet access. All these appliances are equipped with loudspeakers and the associated electronics for sound reproduction.

However, at any given time, only a subset of these loudspeakers is typically used for sound reproduction events within a home. For example, when a family is watching a movie together in the family room, a multi-room background music streaming system will most likely be turned off. Similarly, smart speakers in the home office and master bedroom will typically not be used when the movie is playing.

If the audio content of the movie is created with the latest sound reproduction technology that requires additional audio channels in order to obtain the best listening experience, it would be highly desirable to be able to relocate idle smart speakers (e.g., smart speakers typically located in the home office or master bedroom) to the family room, and use these smart speakers to play the additional channels required by the latest sound reproduction format. After the movie viewing is finished, it would also be desirable to relocate these smart speakers back to their original locations (in the home office and the master bedroom) to serve their original purposes.

It would also be desirable for a work-at-home parent to be able to relocate a mono smart speaker from his/her daughter's bedroom to join a mono loudspeaker in the home office, thereby enabling the playback of stereo music in the home office during school hours. It would also be desirable for the daughter to be able to relocate both mono speakers to her bedroom to play her favorite music in stereo while she is doing her homework.

The repurposing of sound reproduction appliances is highly desirable because it will greatly improve the cost performance of the sound reproduction system at home. Sound quality improvement and cost reduction are conflicting goals. For example, there is almost a 10× difference in price of an Echo Dot and a Sonos Play:5, wherein these devices have similar functionality but different sound quality.

Each household typically has a limited budget for sound reproduction appliances. If sound reproduction appliances can be repurposed in the manner described above, the number of purchased sound reproduction appliances can be reduced (such that the household can afford to purchase higher quality sound reproduction appliances). If these sound reproduction appliances can be joined together to support multiple functions in the manners described above, (e.g., adding channels to support a new audio format), the enjoyment of the sound system at home will be greatly enhanced.

However, the repurposing of conventional sound reproduction appliances is not possible with the current products in the market for the following reasons. First, the loudspeaker systems in conventional sound reproduction appliances are typically driven by different sources, control systems and/or electronics. It is impossible to combine these sound reproduction appliances together to play different audio channels from the same source material. Second, many conventional sound reproduction appliances are immobile. It is highly inconvenient to move conventional sound reproduction appliances around for different sound reproduction functions. Third, most conventional sound reproduction appliances have fixed functions, and cannot be reprogrammed.

It would therefore be desirable to have an extended cognitive loudspeaker system that enables the dynamic formation and dissolution of multiple playgroups, wherein sound production stations can be dynamically included in different playgroups. It would be further desirable to be able to control the physical movement of sound production stations within the home.

SUMMARY

The present invention provides an extended cognitive loudspeaker system that includes a system manager coupled to a wireless network through a basic service set (BSS) of the wireless network, wherein the system manager establishes a cognitive loudspeaker system (CLS) network using an independent basic service set (IBSS) of the wireless network. The wireless network can be, for example, a WiFi network in accordance with the IEEE 802.11 Standard.

The system manager forms a first CLS playgroup through the CLS network IBSS, wherein the first CLS playgroup includes a first control station for receiving a first audio playback stream and a first group of one or more sound production stations for performing audio playback in response to the first audio playback stream. The system manager further forms a second CLS playgroup through the CLS network IBBS, wherein the second CLS playgroup includes a second control station for receiving a second audio playback stream and a second group of one or more sound production stations for performing audio playback in response to the second audio playback stream.

In one embodiment, the extended cognitive loudspeaker system includes a service console coupled to the system manager through the BSS of the wireless network, wherein the service console provides a user interface to the system manager.

In another embodiment, the system manager specifies an audio channel of each sound production station of the first group of one or more sound production stations through the CLS network IBSS. For each sound production station in the first group, the first control station generates a playback executable in response to the audio channel assigned to the sound production station, and transmits the playback executable to the corresponding sound production station through the CLS network IBSS, wherein the sound production station uses the playback executable to decode the first audio playback stream.

In another embodiment, a first sound production station of the first group includes a mobility mechanism controlled by the system manager through the CLS network IBSS, wherein the mobility mechanism moves the first sound production station. The mobility mechanism can include, for example, remotely controlled motorized wheels. In another embodiment, the mobility mechanism includes a self-navigation system, which moves the first sound production station in response to mapping information and instructions provided by the system manager.

In another embodiment, the system manager includes means for authorizing and associating the first control station, the second control station, the first group of one or more sound production stations and the second group of one or more sound production stations with the CLS network IBSS.

In yet another embodiment, the system manager includes means for dissolving the first and second CLS playgroups.

In another embodiment, the system manager includes means for establishing a third CLS playgroup that includes a first sound production station from the first group of sound production stations and a second sound production station from the second group of sound production stations.

The present invention also includes a method of implementing an extended cognitive loudspeaker system, wherein the method includes: (1) establishing a cognitive loudspeaker system (CLS) network using an independent basic service set (IBSS) of a wireless network; (2) authorizing and admitting a plurality of CLS components into the CLS network IBBS, wherein the plurality of CLS components include a first control station, a first sound production station and a second sound production station; (3) forming a first CLS playgroup that includes the first control station and the first sound production station, but not the second sound production station; (4) dissolving the first CLS playgroup; and then (4) forming a second CLS playgroup that includes the first control station, the first sound production station and the second sound production station.

In one embodiment, forming the first CLS playgroup includes: (1) assigning an audio channel to the first sound production station; and (2) moving the first sound production station to a location corresponding with the assigned audio channel. Moving the first sound production station may include: (1) transmitting instructions to the first sound production station using the CLS network IBSS; and (2) controlling a mobility mechanism of the first sound production station in response to the transmitted instructions.

In another embodiment, forming the first CLS playgroup includes: (1) assigning an audio channel to the first sound production station; (2) assigning a unique playgroup identification value to the first CLS playgroup; (3) allocating a channel in the wireless network to the first CLS playgroup; (4) storing the playgroup identification value and the audio channel in the first sound production station; (5) activating the first sound production station; (6) storing the playgroup identification value in the first control station; and then (7) activating the first control station.

In yet another embodiment, forming the first CLS playgroup comprises assigning a unique playgroup identification value to the first control station and the first sound production station, but not the second sound production station, and dissolving the first CLS playgroup comprises: (1) broadcasting a playgroup dissolution message that includes the playgroup identification value to the plurality of CLS components; and (2) deactivating the first control station and the first sound production station, but not the second sound production station, in response to the playgroup identification value in the playgroup dissolution message.

The present invention also includes a method of implementing an extended cognitive loudspeaker system, wherein the method includes: (1) establishing a cognitive loudspeaker system (CLS) network using an independent basic service set (IBSS) of a wireless network, wherein the wireless network includes a basic service set (BSS) that provides access to the Internet; (2) forming a first CLS playgroup in the CLS network IBSS, wherein the first CLS playgroup includes a first control station for receiving a first audio playback stream and a first sound production station for performing audio playback in response to the first audio playback stream; and (3) forming a second CLS playgroup in the CLS network IBBS, wherein the second CLS playgroup includes a second control station for receiving a second audio playback stream and a second sound production station for performing audio playback in response to the second audio playback stream.

In one embodiment, this method further includes: dissolving the second CLS playgroup, and then modifying the first CLS playgroup to include both the first and second sound production stations.

In another embodiment, this method further includes: (1) assigning an audio channel to the first sound production station; (2) generating a playback executable based on the assigned audio channel of the first sound production station; (3) transmitting the playback executable to the first sound production station through the CLS network IBSS; and (4) using the playback executable within the first sound production station to decode the first audio playback stream.

In another embodiment, this method further includes controlling a mobility mechanism of the first sound production station through the CLS network IBSS, wherein the mobility mechanism moves the first sound production station to a desired location.

The present invention will be more fully understood in view of the following description and drawings.

DETAILED DESCRIPTION

Figure 1:
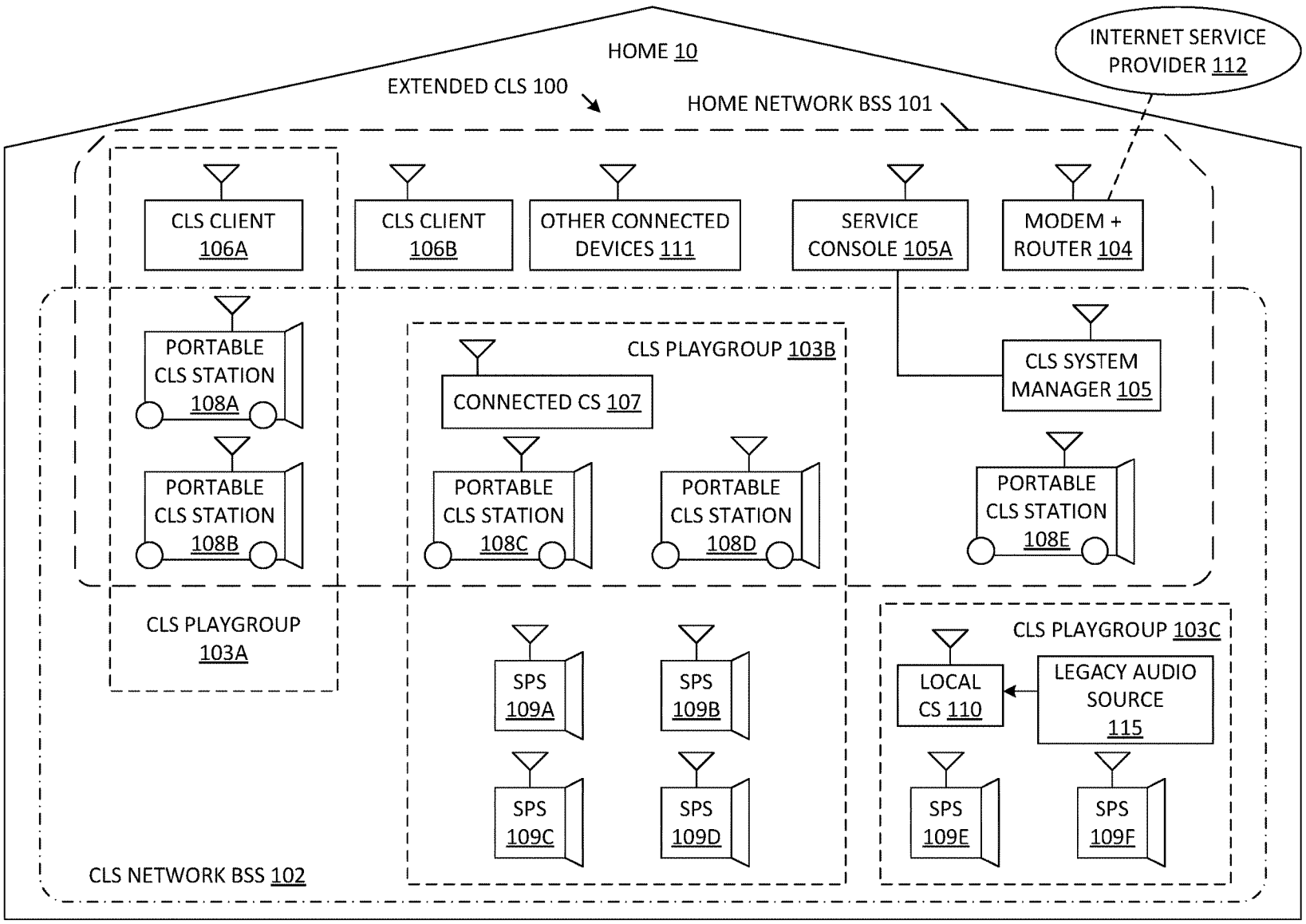
FIG. 1 is a block diagram of an extended cognitive loudspeaker system (CLS) that includes a home network basic service set (BSS) and CLS network independent basic service set (IBSS) in accordance with one embodiment of the present invention.

In general, the present invention provides an extended cognitive loudspeaker system (CLS) that includes a CLS system manager that is configured to operate as an Access Point (AP) of a local CLS network that uses an independent basic service set (IBSS) of a wireless network in accordance with the IEEE 802.11 Standard. The CLS network BSS provides the communication infrastructure to enable the CLS system manager to manage the authentication and activation of various CLS components, form different CLS playgroups from the CLS components, dissolve the CLS playgroups, and support the mobility of certain CLS components. The extended cognitive loudspeaker system of the present invention is described in more detail below.

In accordance with one embodiment, the extended CLS of the present invention is an expansion of the base cognitive loudspeaker system described in commonly owned U.S. Pat. No. 9,282,418 (hereinafter, the '418 patent), U.S. patent application Ser. No. 16/563,469 (hereinafter, the '469 application) and U.S. patent application Ser. No. 17/028,600 (hereinafter, the '600 application), which are hereby incorporated by reference in their entirety.

In general, the '418 patent describes a cognitive loudspeaker system (CLS) that includes an active control station (CS) that communicates wirelessly and bi-directionally with a plurality of sound production stations (SPSs). The control station and the sound production stations are initially synchronized to a conductor clock. During a setup process, configuration information is transmitted from the sound production stations to the active control station. This configuration information includes the audio channel to be implemented by each sound production station. In response to the received configuration information, the active control station generates playback executables for each of the sound production stations. The active control station wirelessly transmits the playback executables to the sound production stations. After the setup process is complete, the active control station wirelessly transmits digital audio information (which is received from a digital audio source) to the sound production stations. Within each sound production station, the previously received playback executable is used to control the decoding and processing of the received digital audio information. Each sound production station generates digital audio output samples in response to the received digital audio information (and the associated playback executable). The digital audio samples are converted to analog output signals, which are amplified and played through loudspeakers. Thus, the active control station establishes a virtual decoder within each of the sound production stations, which enables playback from various sources. The virtual decoder allows the cognitive loudspeaker system to be easily modified/updated to handle new audio coding protocols.

The '469 application describes an improved method for clock synchronization within the control station and the sound production stations of the basic CLS system.

The '600 application describes an indirect playback method, wherein the control station and the SPSs are configured to receive a playback stream that is wirelessly transmitted from a media source device, such as a conventional smart phone. This indirect playback method advantageously saves bandwidth on the wireless transmission medium, because the control station does not have to retransmit the playback stream received from the media source device to the sound production stations.

In general, the base cognitive loudspeaker system enables the alliance of any audio source device with the control station (CS) and any number of associated sound production stations (SPSs) to play any audio format through associated configuration, setup, playback and handover processes. The audio stream is delivered wirelessly to each of the sound production stations, advantageously removing an obstacle to making the sound reproduction stations mobile. However, the base cognitive loudspeaker system provides no usage model or control methods for repurposing the various CLS components. Similarly, the base cognitive loudspeaker system does not address multiple-access issues that arise when multiple cognitive loudspeaker systems operate in the same household.

Accordingly, the present invention provides an extended cognitive loudspeaker system architecture defines the states, inter-networking and communication of CLS components and non-CLS components to allow multiple CLS playgroups to operate simultaneously in different spaces, and to perform different sound reproduction functions within a household. The extended CLS architecture also allows reassignment of CLS components among different CLS playgroups. The extended CLS architecture of the present invention also defines a new CLS component, which is hereinafter referred to as a "portable CLS station". The portable CLS station greatly enhances the cost, performance and flexibility of the extended CLS architecture.

The components of the extended CLS architecture communicate solely on a wireless medium (WM). In one embodiment, a wireless network in accordance with the IEEE 802.11 Standard is used to implement the WM, because this standard has become the de-facto home networking solution. However, other WM with similar functionality can be used for the extended CLS architecture in other embodiments.

In accordance with the IEEE 802.11 Standard, stations (STAs) communicate wirelessly among each other within a Basic Service Set (BSS). Each BSS has an Access Point (AP) device that manages the communications among the STAs within the BSS. Each data frame within a BSS is identified by a unique service set identifier (SSID) associated with the BSS. The AP allows the setup of a Peer-to-Peer communication link between the STAs within a tunneled direct-link setup (TDLS) service.

The BSS is typically set up to connect to the Internet using a standardized protocol above the Media Access Control (MAC) layer. This is especially true for a BSS associated with a home WiFi network. However, the IEEE 802.11 Standard also allows for the coexistence of another independent BSS (IBSS), which doesn't need to be connected to the Internet, and can have custom defined communication protocol layers above the 802.11 MAC/PHY layer. As described in more detail below, an IBSS is used to enable communications between components of the extended CLS architecture.

FIG. 1 is a block diagram of an extended CLS architecture 100 in accordance with one embodiment. Extended CLS architecture 100 includes home network BSS 101 and CLS network BSS 102, which are implemented within a user's home 10. Home network BSS 101 is the conventional WiFi network deployed within home 10. The set of devices connected to home network BSS 101 includes: modem/ router 104, CLS system manager 105 and its associated service console 105A, CLS clients 106A-106B, connected control station (CS) 107, portable CLS stations 108A-108E and other connected devices 111.

Modem/router 104 provides connectivity of the allowed devices of home network BSS 101 to the Internet, via service from Internet service provider 112. CLS system manager 105 and the associated console service 105A control the extended CLS architecture 100, in a manner described in more detail below.

In accordance with the described embodiment, CLS clients 106A and 106B are conventional electronic devices (e.g., a smart phone or a laptop) that may provide playback stream sources for the extended CLS architecture 100.

Connected control station (CS) 107 is a wireless device, such as a smart TV or a music server, which is capable of operating in a first configuration, wherein the connected CS 107 receives a playback stream directly from the Internet (via modem/router 104), and in response, transmits an audio playback stream to each of the associated SPS devices (e.g., SPSs 109A-109D and portable CLS stations 108C-108D) in the corresponding CLS playgroup 103B. In this configuration, the connected control station 107 operates in the manner described in the '418 patent. Alternately, connected control station 107 can operate in a second configuration, wherein the connected control station 107 and each of the SPS devices in the corresponding CLS playgroup 103B receive a playback source data directly from CLS client 106B. In this configuration, the connected CS 107 operates in the manner described in the '600 application.

Portable CLS stations 108A-108E are wireless sound production stations (SPSs) that are described in more detail below. In general, portable CLS stations 108A-108E are mobile components that playback audio signals in response to audio playback streams transmitted by CLS clients 106A-106B and connected control station 107.

The other connected devices 111 are conventional wireless devices that are coupled to modem/router 104 within the home network BSS 101, but are irrelevant to the extended CLS architecture 100 (e.g., a printer or a home security system).

In the context of the IEEE 802.11 standard, the home WiFi network 101 is a Basic Service Set (BSS), wherein modem/router 104 is the Access Point (AP) of this BSS and the devices connected to this Access Point are the stations (STAs) of the home network BSS 101.

The home network BSS 101 provides important services for the extended CLS architecture 100. In accordance with one embodiment, the home network BSS 101 supports link setup between each of the CLS clients 106A-106B and the connected control station 107 or the portable CLS stations 108A-108E. The home network BSS 101 also operates as the streaming source of a playback stream for the CLS clients 106A-106B during indirect stream playback. The home network BSS 101 also supports link setup between the CLS system manager 105 and the service console 105A (assuming that the service console 105A is a remote device, such as a laptop or a smart phone). Note that the link setup between the CLS system manager 105 and the service console 105A is not required if both of these elements are implemented in the same dedicated hardware device.

The extended CLS architecture 100 also includes a CLS network basic service set (BSS) 102. In the context of the IEEE 802.11 Standard, the CLS network BSS 102 is an independent BSS (IBSS). That is, the CLS network BSS 102 is independent of the home network BSS 101. The CLS network BSS 102 is not directly connected to the Internet. Hence, the protocol layer above the 802.11 MAC layer only serves the functions of the CLS network BSS 102, which is described in more detail below. The CLS system manager 105 is the Access Point (AP) of the CLS network BSS 102. The stations (STAs) of the CLS network BSS 102 include: connected control station 107, portable CLS stations 108A-108E, sound production stations 109A-109F, and local control station 110.

The function of the CLS network BSS 102 is to provide the communication infrastructure for the household to: specify the domain of the CLS systems within home 10; manage the deployment of CLS components; form CLS playgroups (103A, 103B, 103C); enable dissolution of the CLS playgroups; and support the mobility of the portable CLS stations 108A-108E.

In accordance with various embodiments of the present invention, CLS system manager 105 performs the following functions. First, system manager 105 performs authentication and association of each of the CLS components of the CLS network BSS 102 (e.g., connected CS 107, local CS 110, portable CLS stations 108A-108E and sound production stations 109A-109F). As described in more detail below in connection with FIGS. 2-3, CLS system manager 105 also manages the states of all the CLS components within the CLS Network BSS 102. CLS system manager 105 also implements console services for the execution and monitoring of functions within the CLS network BSS 102 (in response to inputs received from service console 105A). As described in more detail below in connection with FIG. 4, CLS system manager 105 also manages the formation of CLS playgroups (e.g., 103A, 103B and 103C) by: assigning a Playgroup_ID value to each of the CLS components included in a CLS playgroup; commanding state changes to the SPS components assigned to each CLS playgroup; allocating a channel of the wireless medium to each CLS playgroup; and kickstarting a "Setup Process" by commanding state changes to the control station (CS) component assigned to each CLS playgroup. As described below in more detail in connection with FIG. 5, CLS system manager 105 also manages the dissolution of the CLS playgroups by commanding state changes to the CLS components of each CLS playgroup to be dissolved.

CLS system manager 105 also supports the mobility of the portable CLS stations 108A-108E. In different embodiments, the portable CLS stations 108A-108E use a wide range of mobility mechanisms. In one embodiment, CLS system manager 105 operates as a communication hub for a controlling device (e.g., service console 105A) that controls the movement of the portable CLS stations remotely. In another embodiment, CLS system manager 105 provides a map and location services to portable CLS stations having a self-navigation capability.

In various embodiments, the CLS system manager 105 is implemented within a smart TV or a home server. In another embodiment, the CLS control functions of the CLS system manager 105 are implemented within modem/router 104.

CLS system manager 105 controls the states of the CLS components within the CLS network BSS 102. In the embodiment of FIG. 1, CLS system manager 105 control the states of connected control station 107 and local control station 110, which are generally referred to as control station (CS) components. Connected control station 107 is connected to the Internet (via modem/router 104) and can source a playback stream directly or indirectly from the Internet. In various embodiments, connected control station 107 is implemented by a smart TV, a music server or a smart home speaker. Local control station 110 does not receive audio playback streams from the Internet, but rather, includes a CLS bridge element that receives an audio playback stream from a legacy audio appliance 115, such as a CD player or a turntable.

CLS system manager 105 also controls the states of portable CLS stations 108A-108E and sound production stations (SPSs) 109A-109F, which are generally referred to a SPS components. Sound production stations 109A-109F are described in detail in the '418 patent, the '469 application and the '600 application. Examples include a loudspeaker with SPS logic, and an SPS transceiver coupled to a legacy loudspeaker and its associated amplification electronics.

Figure 2:
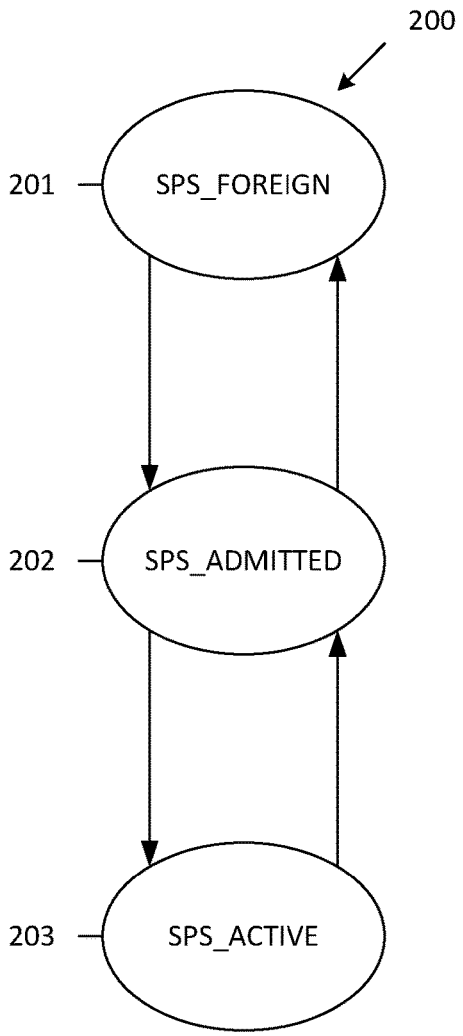
FIG. 2 is a state diagram illustrating the states of sound production station (SPS) components within the CLS network IBSS of FIG. 1 in accordance with one embodiment of the present invention.

FIG. 2 is a state diagram 200 illustrating the states of SPS components within CLS network BSS 102 in accordance with one embodiment of the present invention. In the SPS Foreign state 201, the SPS component is not yet associated with the CLS network BSS 102 within home 10. Upon detecting the presence of an SPS component (e.g., through an auto-detection mechanism or through a notification received via service console 105A), the CLS system manager 105 authenticates and associates the SPS component within the CLS network BSS 102, using the AP services of the CLS network BSS 102. More specifically, the CLS system manager 105 selects a Household ID value, which is uniquely defined for home 10. In one embodiment, the Household ID is the SSID of the WiFi home network BSS 101. In another embodiment, the Household ID is the MAC address of the device used to implement the CLS system manager 105. In yet another embodiment, the user selects the Household ID value (e.g., the user enters a desired Household ID value using service console 105A, wherein the service console 105A provides the entered Household ID value to the CLS system manager 105), such that the Household ID value is not dependent on the hardware used in the extended CLS architecture 100. The Household ID value is used to identify and associate all CLS components with the CLS network BSS 102 within home 10. Thus, in the present example, the CLS system manager 105 associates the SPS component with the Household ID value of the CLS network BSS 102. As a result, the SPS component transitions from the SPS Foreign state 201 to the SPS_Admitted state 202.

In the SPS_Admitted state 202, the SPS component is not used, but is ready to be deployed. That is, the SPS component has not yet been added to a CLS playgroup, but the SPS component is available to be added to a CLS playgroup. If desired, the SPS component can be removed from CLS network BSS 102 via the AP services of the CLS system manager 105 (e.g., in response to an instruction issued from the service console 105A), thereby causing the SPS component to transition from the SPS_Admitted state 202 to the SPS Foreign state 201. Note that to enter the SPS Foreign state 201, the CLS system manager 105 disassociates the SPS component from the Household ID value. Such a disassociation may be desirable if the SPS component is no longer used in the home 10 (e.g., due to upgrading to another SPS component that has better performance, or due to the user transferring ownership of the SPS component to a different household).

When the SPS component is in the SPS_Admitted state 202, the CLS system manager 105 may issue a state change command to activate the SPS component for use within a CLS playgroup, causing the state of the SPS component to transition to the SPS_Active state 203. The activating state change command issued by the CLS system manager 105 assigns a unique Playgroup_ID value, a wireless medium channel and an audio channel (e.g., right channel, left channel, center channel, etc.) to the SPS component. In the SPS_Active state 203, the SPS component is operational, and is subject to the control of the control station (CS) of the CLS playgroup identified by the Playgroup_ID value.

If desired, the activated SPS component can be disassociated from the assigned CLS playgroup via the AP services of the CLS system manager 105 (e.g., in response to an instruction issued from the service console 105A), thereby causing the SPS component to transition from the SPS_Active state 203 to the SPS_Admitted state 202. Note that all SPS components in the SPS_Admitted state 202 and the SPS_Active state 203 are associated with the same Household ID value.

Figure 3:
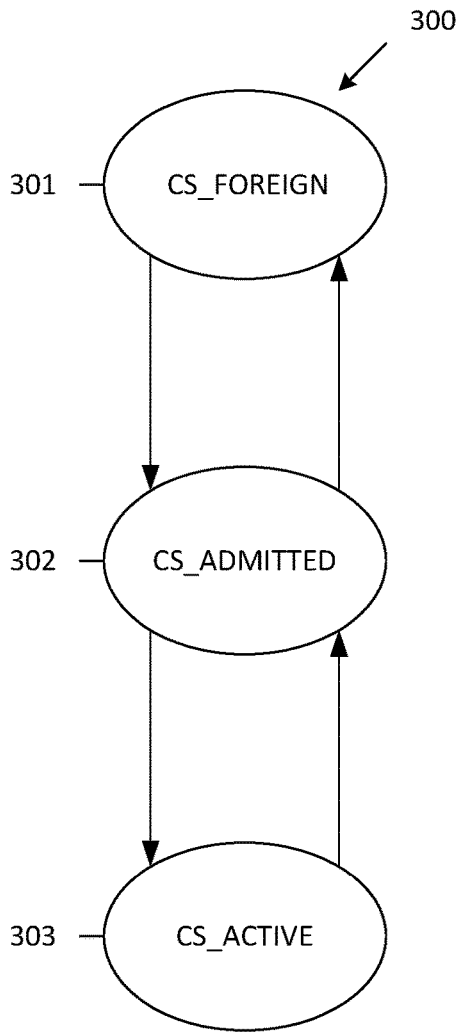
FIG. 3 is a state diagram illustrating the states of control station (CS) components within CLS network IBSS of FIG. 1 in accordance with one embodiment of the present invention.

FIG. 3 is a state diagram 300 illustrating the states of CS components within CLS network BSS 102 in accordance with one embodiment of the present invention. In the CS Foreign state 301, the CS component is not yet associated with the CLS network BSS 102 within home 10. Upon detecting the presence of an CS component (e.g., through an auto-detection mechanism or through a notification received via service console 105A), the CLS system manager 105 authenticates and associates the CS component within the CLS network BSS 102, using the AP services of the CLS network BSS 102. At this time, the CS component becomes identified with the Household ID value of the CLS network BSS 102. As a result, the CS component transitions from the CS Foreign state 301 to the CS_Admitted state 302.

In the CS_Admitted state 302, the CS component is not used, but is ready to be deployed. That is, the CS component has not yet been assigned to a CLS playgroup, but the CS component is available to be assigned to a CLS playgroup. If desired, the CS component can be removed from CLS network BSS 102 via the AP services of the CLS system manager 105 (e.g., in response to an instruction issued from the service console 105A), thereby causing the CS component to transition from the CS_Admitted state 302 to the CS Foreign state 301. Note that to enter the CS Foreign state 201, the CLS system manager 105 disassociates the CS component from the Household ID value. Such a disassociation may be desirable if the CS component is no longer being used in the home 10.

When the CS component is in the CS_Admitted state 302, the CLS system manager 105 may issue a state change command to activate the CS component for use within a CLS playgroup, causing the state of the CS component to transition to the CS_Active state 303. The activating state change command issued by the CLS system manager 105 assigns a unique Playgroup_ID value and a wireless medium channel to the CS component. As described in more detail below in connection with FIG. 4, this state transition is only performed after all the SPS components of the same CLS playgroup have been assigned and moved to their desired locations. Upon transitioning into the CS_Active state 303, the CS component will automatically initiate the CLS setup process. In general, the activated CS component establishes communication with each of the SPS components in the CLS playgroup identified by the Playgroup_ID value. The activated CS component generates playback executables for each of these SPS components (based on the audio coding format and the audio channels assigned to the SPS components) and downloads the playback executables to the corresponding SPS components. If indirect playback is specified, the activated CS component configures the associated SPS components to receive a playback stream directly from another media playback source. After the SPS components are initialized, the CLS playgroup assigned to the CS component is operational. The CS component controls the assigned SPS components until the CLS playgroup is dissolved.

If desired, the established CLS playgroup can be dissolved via the AP services of the CLS system manager 105 (e.g., in response to an instruction issued from the service console 105A), thereby causing the CS component to transition from the CS_Active state 303 to the CS_Admitted state 302 (and causing the SPS components of the same CLS playgroup to transition from the SPS_Active state 203 to the SPS_Admitted state 202). From the CS_Admitted state 302, the CS component can be redeployed (i.e., transition to CS_Active state 303) or removed from the CLS network BSS 102 (i.e., transition to CS Foreign state 301). Note that all CS components in the CS_Admitted state 302 and the CS_Active state 303 are associated with the same Household ID value.

CLS Playgroups

Each CLS playgroup established by the CLS system manager 105 includes one assigned CS component and zero or more assigned SPS components. In the example of FIG. 1, CLS playgroup 103A includes CLS client 106A, which provides an audio playback stream, portable CLS station 108A which functions as both a control station and a sound production station, and portable CLS station 108B, which functions as a sound production station. CLS playgroup 103B includes connected control station 107, which functions as a control station, and portable CLS stations 108C-108D and SPSs 109A-109D, which function as sound production stations. Note that connected control station 107 can receive input media playback streams from the Internet (via home network BSS 101), CLS client 106B, or directly from a cable/satellite television service provider (not shown). CLS playgroup 103C includes legacy audio source 115, which provides an audio playback stream, local CS 110, which functions as a control station, and SPSs 109E-109F, which function as sound production stations. Because each CLS playgroup is configured to play audio content from a single source at a time, all the CLS components of each CLS playgroup should be located in the same room of home 10.

Figure 4:
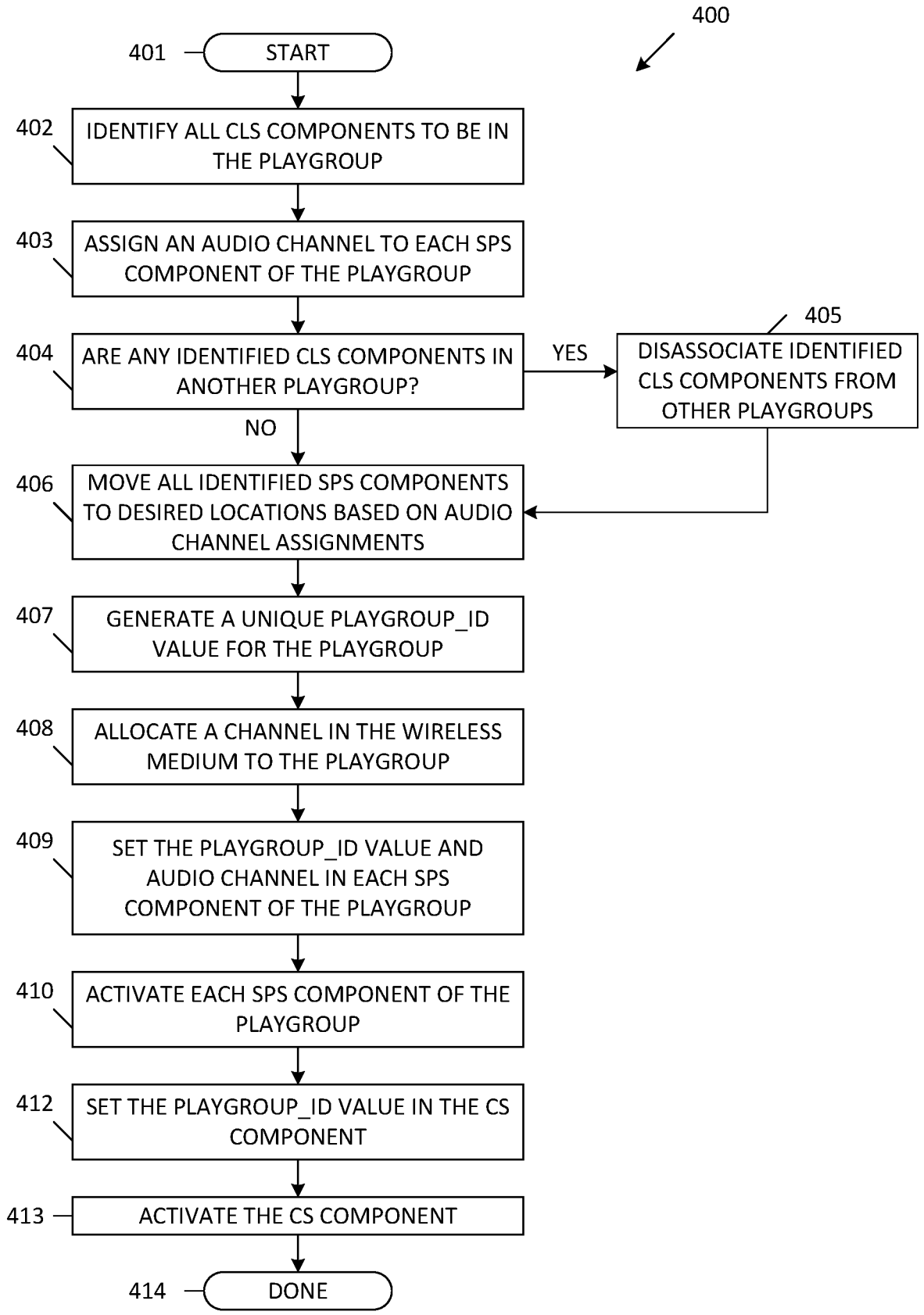
FIG. 4 is a flow diagram illustrating the formation of a CLS playgroup in accordance with one embodiment of the present invention.

FIG. 4 is a flow diagram 400 illustrating the formation of a CLS playgroup in accordance with one embodiment of the present invention. The formation of a CLS playgroup is initiated (Step 401) by CLS system manager 105. In one embodiment, CLS manager 105 receives an instruction to form the CLS playgroup from service console 105A. Note that a user can request the formation of the CLS playgroup using an application installed on service console 105A.

Upon receiving the instruction to form a CLS playgroup, all of the CLS components to be included in the CLS playgroup are identified (Step 402). In one embodiment, the CLS system manager 105 transmits information to service console 105A, identifying all of the CLS components that are in the SPS_Admitted state 202, the SPS_Active state 203, the CS_Admitted state 302 or the CS_Active state 303. As described above, all these CLS components are identified by the same Household ID value. Service console 105A displays information identifying these CLS components to a user. The user then uses the service console 105A to select which of the identified CLS components will be included in the CLS playgroup. For example, the user may select connected control station 107, portable CLS stations 108C-108D and SPSs 109A-109D to be included in the CLS playgroup 103B.

Each SPS component of the CLS playgroup is assigned an audio channel (Step 403). In one embodiment, the user selects the audio channel for each SPS component using the service console 105A. For example, the user may specify that SPS 109A forms a subwoofer audio channel, SPS 109A operates as a center audio channel, SPS 109C operates as a left front audio channel, SPS 109D operates as a right front audio channel, portable CLS station 108C operates as a right rear audio channel, and portable CLS station 108D operates as a left rear audio channel.

The above described selections are communicated from the service console 105A to the CLS system manager 105 via the home network BSS 101. The CLS system manager 105 determines whether any of the identified CLS components are active in another CLS playgroup (Step 404). That is, the CLS system manager 105 determines whether any of the identified CLS components are in the SPS_Active state 203 or the CS_Active state 303.

If not (Step 404, No), processing proceeds to Step 406. If so (Step 404, Yes branch), the CLS system manager 105 disassociates the identified CLS components from the other playgroups. That is, the CLS system manager 105 causes any identified CS component in the CS_Active state 303 to transition to the CS_Admitted state 302, and causes any identified SPS component in the SPS_Active state 203 to transition to the SPS_Admitted state 202. Processing then proceeds to Step 406.

In Step 406, all identified SPS components of the CLS playgroup are moved to desired location within home 10, based on the audio channel assignments. For example, within the room where the CLS playgroup is to be located, SPS 109A (subwoofer audio channel) is to a corner of the room, SPS 109A (center audio channel) is moved to a center location of the room, SPS 109C (left front audio channel) is moved to a left front area of the room, SPS 109D (right front audio channel) is moved to a right front area of the room, portable CLS station 108C (right rear audio channel) is moved to a right rear area of the room, and portable CLS station 108D (left rear audio channel) is moved to a left rear area of the room). The SPSs 109A-109D may be physically moved to the desired locations (or these SPSs may already be 'permanently' positioned at these locations). The portable CLS stations 108C-108D are positioned at the desired locations using associated mobility mechanisms, which are described in more detail below.

CLS system manger 105 then generates a unique Playgroup_ID value for the new CLS playgroup (Step 407) and allocates a communication channel for the new CLS playgroup in the wireless medium, using CLS network BSS 102 (Step 408).

CLS system manager 105 then transmits playgroup membership messages to each of the SPS components of the CLS playgroup, wherein each playgroup membership message specifies the unique Playgroup_ID value and the assigned audio channel of the SPS component (Step 409). In response, each of the SPS components stores the unique Playgroup_ID value and the assigned audio channel. Each of the SPS components subsequently uses the unique Playgroup_ID value to communicate with the other CLS components of the CLS playgroup. That is, each SPS component will include the unique Playgroup_ID value in messages transmitted to other CLS components of the CLS playgroup. Similarly, each SPS component will treat any received messages that include the unique Playgroup_ID value as valid messages of the CLS playgroup.

CLS system manager 105 then sends a message (including the unique Playgroup_ID value) to the SPS components of the CLS playgroup, instructing the SPS components to transition from the SPS_Admitted state 202 to the SPS_Active state 203 (Step 410). In response, each of the SPS components is activated.

CLS system manager 105 then transmits a playgroup membership message to the CS component of the CLS playgroup, wherein this playgroup membership message specifies the unique Playgroup_ID value assigned to the CLS playgroup (Step 412). In response, the CS component stores the unique Playgroup_ID value. The CS component subsequently uses the unique Playgroup_ID value to communicate with the SPS components of the CLS playgroup. That is, the CS component will include the unique Playgroup_ID value in messages transmitted to the SPS components of the CLS playgroup. Similarly, the CS component will treat any received messages that include the unique Playgroup_ID value as valid messages.

CLS system manager 105 then sends a message (including the unique Playgroup_ID value) to the CS component of the CLS playgroup, instructing the CS component to transition from the CS_Admitted state 302 to the CS_Active state 303 (Step 412). In response, the CS component is activated, and the formation of the CLS playgroup is completed (Step 414).

Note that activating the CS component of the CLS playgroup kick starts the setup process of the CLS playgroup in the manner described by the '418 patent, the '469 application and the '600 application. More specifically, the SPS components transmit messages to the CS component, informing the CS component of the various audio channels assigned to the SPS components. The CS component then generates a corresponding playback executable for each of the SPS components, and transmits these playback executables to the SPS components. Each of the SPS components installs its corresponding playback executable, thereby enabling each SPS component to properly decode the subsequently received audio playback stream, which is wirelessly transmitted by the CS component (in accordance with the '418 patent) or by a CLS client (e.g., CLS client 106B, in accordance with the '600 application).

Figure 5:
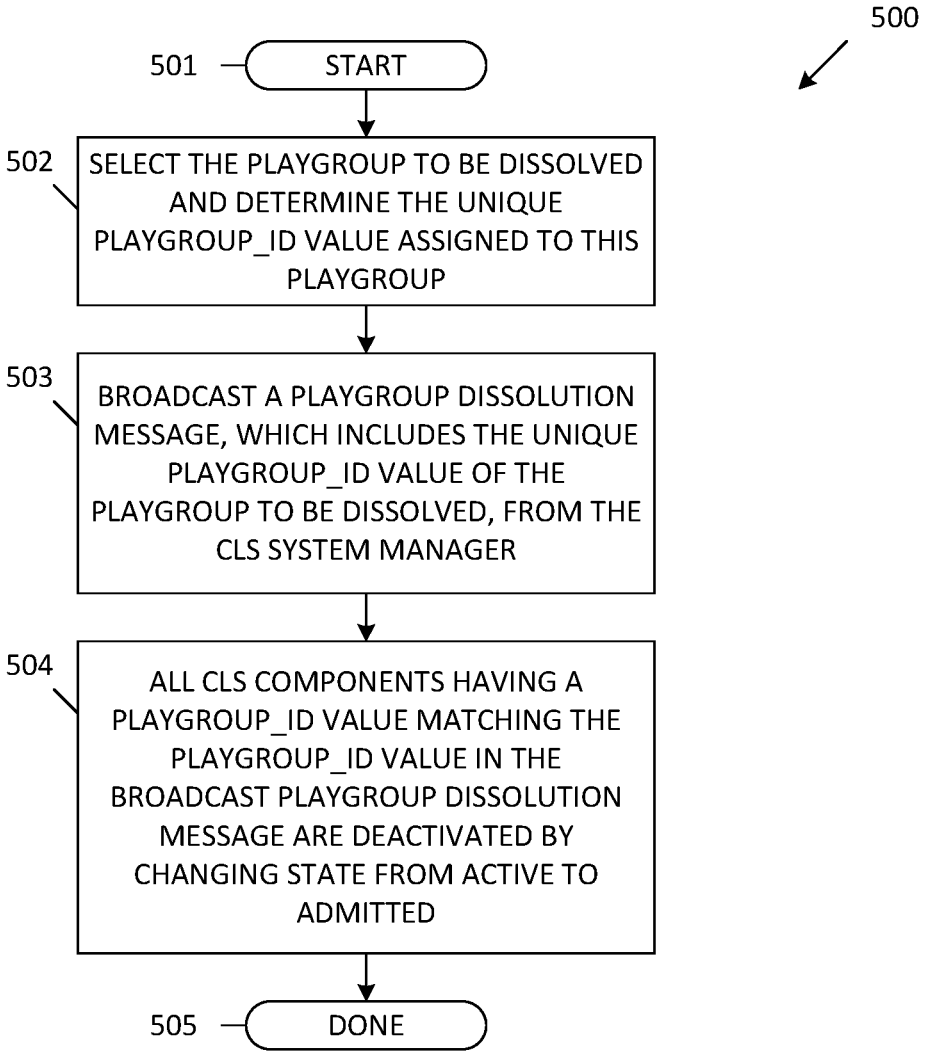
FIG. 5 is a flow diagram illustrating the dissolution of a CLS playgroup in accordance with one embodiment of the present invention.

FIG. 5 is a flow diagram 500 illustrating the dissolution of a CLS playgroup in accordance with one embodiment of the present invention. The dissolution of a CLS playgroup is initiated (Step 301) by CLS system manager 105. In one embodiment, CLS system manager 105 receives an instruction to dissolve the CLS playgroup from service console 105A. Note that a user can request the dissolution of the CLS playgroup using an application installed on service console 105A.

Upon receiving an instruction to dissolve a CLS playgroup, the CLS system manager 105 determines the unique Playgroup_ID value assigned to the CLS Playgroup (Step 502). Note that this unique Playgroup_ID value was originally specified by the CLS system manager 105 during formation of the CLS playgroup.

CLS system manager 105 then broadcasts a playgroup dissolution message using the CLS network BSS 102, wherein this playgroup dissolution message includes the unique Playgroup_ID value of the CLS playgroup to be dissolved (Step 503).

Upon receiving the broadcast playgroup dissolution message, each of the CLS components of the CLS playgroup confirms that the Playgroup_ID value of the playgroup dissolution message matches its own corresponding Playgroup_ID value, and in response, deactivates by changing state (Step 504). More specifically, the CS component of the CLS playgroup transitions from the CS_Active state 303 to the CS_Admitted state 302, and the SPS components of the CLS playgroup transition from the SPS_Active state 203 to the SPS_Admitted state 202. At this time, the dissolution of the CLS playgroup is complete (Step 505).

Figure 6:
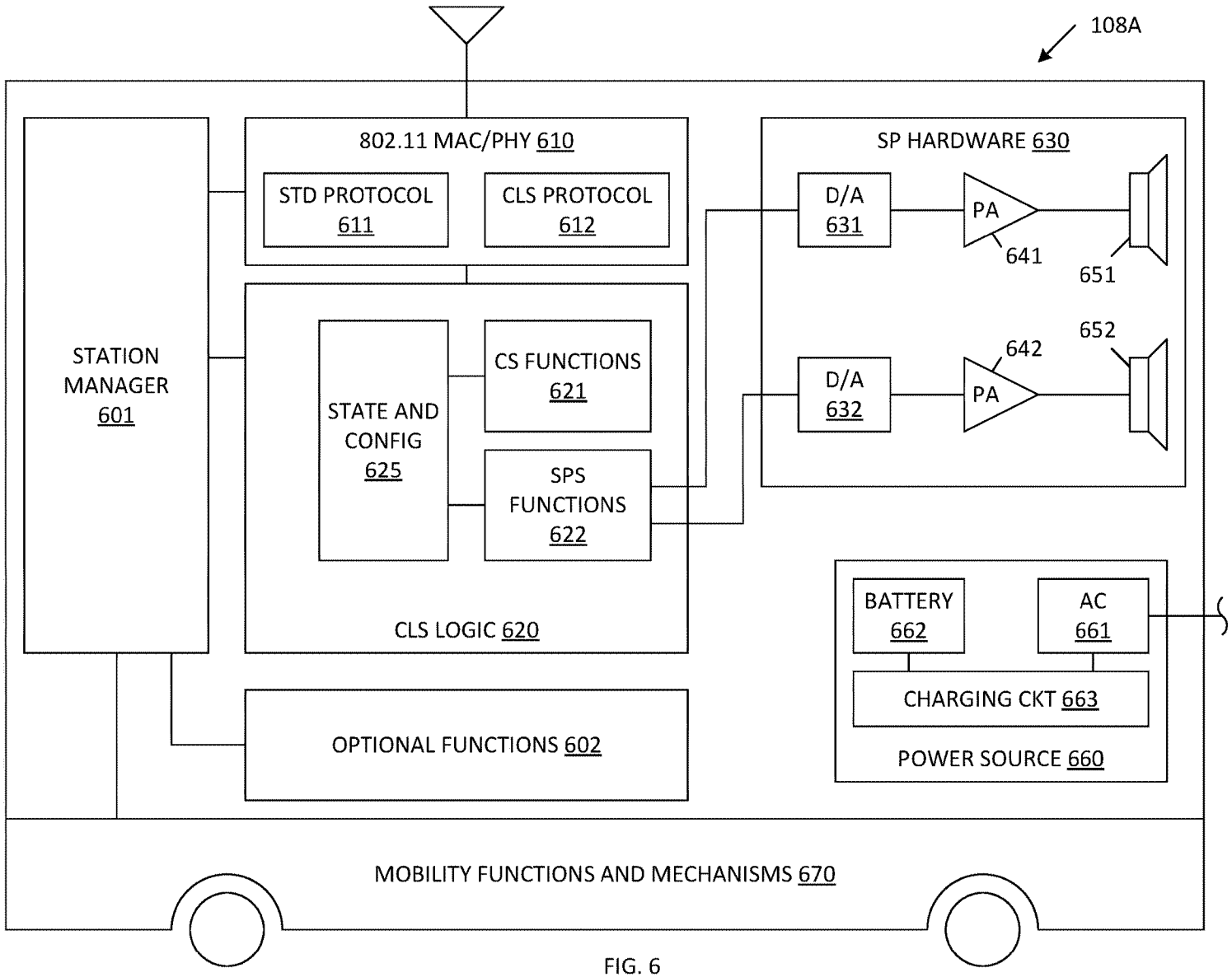
FIG. 6 is a block diagram of portable CLS station in accordance with one embodiment of the present invention.

FIG. 6 is a block diagram of portable CLS station 108A in accordance with one embodiment of the present invention. Each of the portable CLS stations 108B-108E can be implemented with similar circuitry as portable CLS station 108A. Portable CLS station 108A includes station manager 601, optional functions 602, IEEE 802.11 standard MAC/PHY interface layers 610 (which include standard protocol layer 611 and CLS protocol layer 612), CLS logic 620 (which includes CS functions 621, SPS functions 622 and state and configuration logic 625), sound production hardware 630 (which includes digital-to-analog converters 631-632, power amplifiers 641-642, and loudspeakers 651-652), power source 660 (which includes AC source 661, battery 662 and recharging circuit 663) and mobility functions and mechanisms 670.

IEEE 802.11 standard MAC/PHY interface layers 610 serve both the standard protocol 611 of home network BSS 101 and the CLS protocol 612 of CLS network BSS 102, thereby enabling portable CLS station 108A to send and receive messages on the wireless medium. Station manager 601 receives instructions from CLS system manager 105 indicating whether portable CLS station 108A should be configured to operate as a control station (CS), a sound production station (SPS), or both. If portable CLS station 108A is to be configured to operate as a control station, station manager 601 sets values in state and configuration logic 625 that enables CS functions 621 and disables SPS functions 622. If portable CLS station 108A is to be configured to operate as a sound production station, station manager 601 sets values in state and configuration logic 625 that disables CS functions 621 and enables SPS functions 622. If portable CLS station 108A is to be configured to operate as both a control station and a sound production station, station manager 601 sets values in state and configuration logic 625 that enables both CS functions 621 and SPS functions 622. Note that if the portable CLS station 108A is configured to operate as an SPS, the service console 105A is used to specify the audio channel to be implemented by the SPS functions 622, in the manner described above. In one embodiment, the configuration of the portable CLS station 108A is set prior to including this station in a CLS playgroup. Note that the CS functions 621 and SPS functions 622 are the essential functions of a control station and a sound production station in accordance with the descriptions provided by the '418 patent, the '469 application and the '600 application.

The SPS functions 622, when enabled, provide digital audio samples to sound production hardware 630, which includes digital-to-analog (D/A) converters 631-632, power amplifiers (PA) 641-642 and loudspeakers 651-652, as illustrated.

In various embodiments, portable CLS station 108A includes optional functions 602, which may include: a microphone, a camera, a smart home service and/or an audio signal analyzer.

Mobility functions and mechanism 670 enable portable CLS station 108A to be physically moved from one location to another location within home 10. There are many ways to implement mobility functions and mechanism 670. In one embodiment mobility functions and mechanism 670 include a handle and wheels that allow the portable CLS station 108A to be manually rolled from one location to another.

In another embodiment, mobility functions and mechanism 670 includes remotely controllable motorized wheels attached to the portable CLS station 108A, a camera that transmits images of the path of the portable CLS station 108A to service console 105A (via CLS system manager 105), and a remote control system that allows a user to transmit instructions from the service console 105A to the portable CLS station 108A (via CLS system manager 105), wherein these transmitted instructions control the path of the portable CLS station 108A by controlling the operation (i.e., speed and direction) of the motorized wheels. Existing technology for remotely controlling the motion of the portable CLS station 108A in this manner is widely available in remote control toy cars that cost less than $50.

In another embodiment, mobility functions and mechanisms 670 include artificial intelligence (AI) and self-driving vehicle technologies, which are used to move the portable CLS station 108A between desired locations within home 10. In a particular embodiment, portable CLS station 108A is moved by self navigation, based on mapping information provided by CLS system manager 105. Alternately, the station manager 601 supports the mobility of the portable CLS station 108A by operating as a communication hub for an external controlling device that controls the movement of the portable CLS station 108A remotely. In another embodiment, station manager 601 stores a map of the home 10 and provides a location service to allow for self-navigation capability (e.g., station manager 601 enables the portable CLS station 108A to self-navigate between different rooms of the home in response to a received instruction, such as 'move to family room'.)

The various elements of portable CLS station 108A are powered from a power source 660. In one embodiment, power source 660 includes a battery 662 that is rechargeable via a charging circuit 663 and an AC power source 661.

Figure 7:
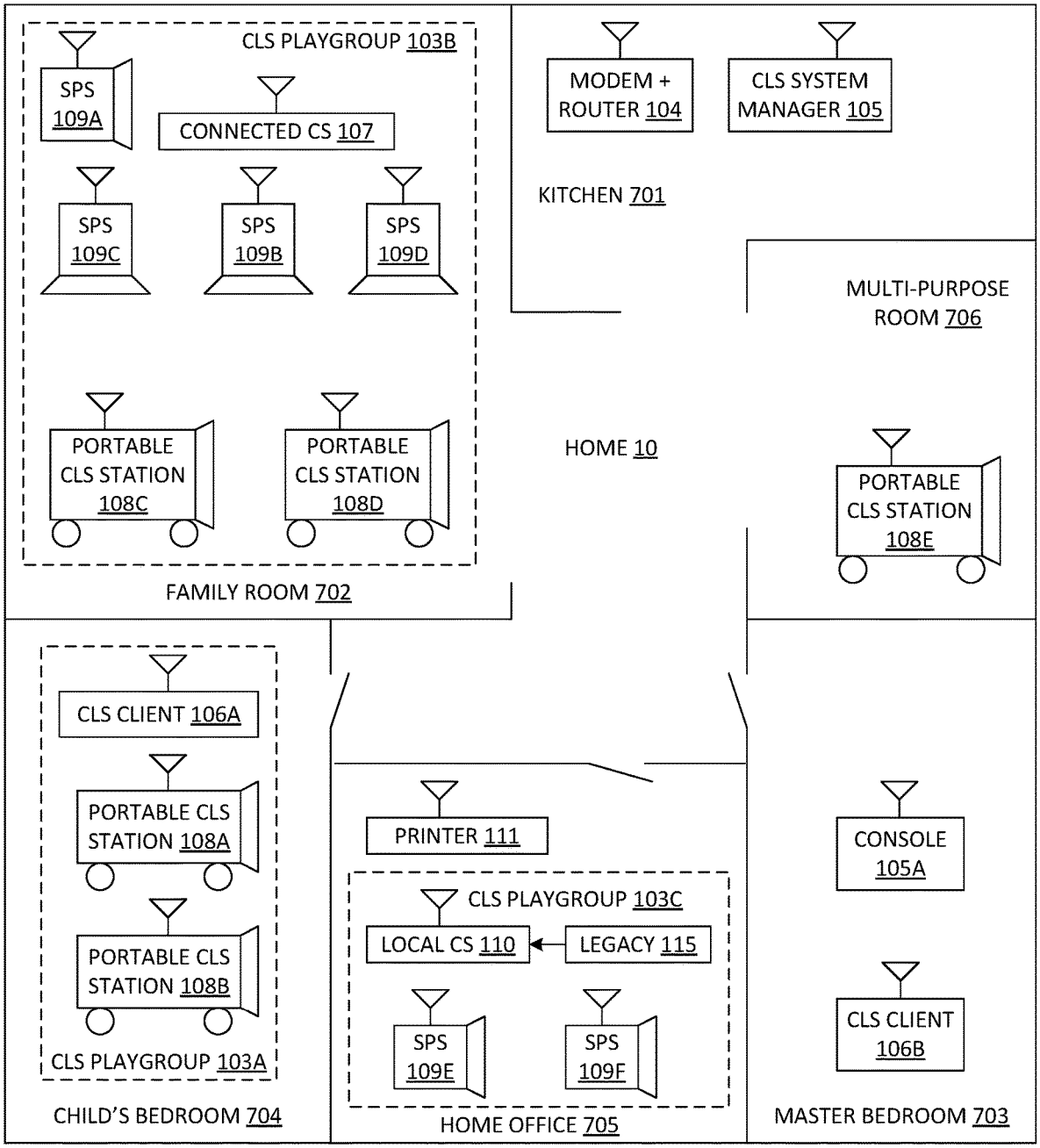
FIG. 7 is a diagram that illustrates a possible layout scenario of the extended CLS architecture of FIG. 1 in accordance with one embodiment of the present invention.

FIG. 7 is a diagram that illustrates a possible layout scenario of the extended CLS architecture 100 within the home 10 depicted in FIG. 1. Modem/router 104 and CLS system manager 105 are located in the kitchen area 701 of the home 10. Service console 105A is implemented by an application installed on a smart phone. This application is used to establish the CLS playgroups 103A-103C in the manner described above. In one embodiment, this application is also used as a remote control to move the portable CLS stations 108A-108E to desired locations within home 10, in the manners described herein. Portable CLS station 108E is not currently associated with any CLS playgroup in the extended CLS system of FIG. 7. In one embodiment, service console 105A is used to establish a CLS playgroup that includes portable CLS station 108E, wherein both the control station functions and the sound production station functions of portable CLS station 108E are enabled, and a smart phone implementing service console 105A is used to stream music to portable CLS station 108E to play background music in home 10.

As illustrated by FIG. 7, CLS playgroup 103A is a stereo system setup in the child's bedroom 704 (using service console 105A). In the illustrated embodiment, CLS client 106A is implemented by a laptop computer that the child uses to do homework and to play computer games. In one embodiment, portable CLS station 108A is configured to operate as a control station, as well as the sound production station for one of the audio channels (e.g., the left stereo channel). Portable CLS station 108B is configured to operate as the SPS for the other audio channel of CLS playgroup 103A (e.g., the right stereo channel). In this embodiment, the laptop computer 106A transmits an audio playback stream, which is received by portable CLS station 108A. The control station function of this portable CLS station 108A causes the audio playback stream to be provided to the on-board SPS function, which plays the associated (left) audio channel. The control station function of this portable CLS station 108 also wirelessly transmits the audio playback stream to portable CLS station 108B. In response, the SPS function of this portable CLS station 108B plays the associated (right) audio channel.

In the described embodiment, portable CLS station 108A can only be moved manually, such that this portable CLS station 108A remains in the child's room 704 most of the time. However, this portable CLS station 108A can occasionally be moved to other rooms in manners described in more detail below.

In the described embodiment, the portable CLS station 108B has the above-described mobility feature that enables this station 108B to be moved by remote control. Thus, this portable CLS station 108B can occasionally be moved by remote control (via service console 105A and CLS system manager 105) to other rooms to join other CLS playgroups in manners described in more detail below.

CLS playgroup 103B is a surround system established by service console 105 in the family room 702 in the manner described above. The connected control station 107 of CLS playgroup 103B is an 85-inch 8k TV having built-in control station functionality. Connected control station 107 is connected to the Internet by home network BSS 101, thereby enabling connected control station 107 to receive content that is streamed from the major content providers (e.g., Netflix, Amazon Prime, Hulu, etc.) SPS 109B is a wireless soundbar having built-in SPS functionality, which hangs from the ceiling in family room 702. SPSs 109C and 109D are high-fidelity active loudspeakers with built-in SPS functionality, which operate as left and right front channels, respectively. SPS 109A is a wireless subwoofer with built-in SPS functionality. Portable CLS stations 108C and 108D serve as left rear (LR) and right rear (RR) channels, respectively. In the illustrated embodiment, portable CLS stations 108C-108D are low cost products, which can only be moved manually. When the portable CLS stations 108C-108D are not required (e.g., when the audio playback source does not include rear surround channels), these stations 108C-108D can be tucked away into the corners of the family room 702 to free up space.

On various occasions, portable CLS stations 108C-108D are moved from the family room 102 to another room in home 10 (e.g., multi-purpose room 706 or master bedroom 703). In this case, service console 105A is used to create a new playgroup (not shown) which includes portable CLS stations 108C-108D. Note that service console 105A is used to dissolve CLS playgroup 103B prior to establishing this new CLS playgroup, thereby disassociating the portable CLS stations 108C-108D from CLS playgroup 103B. The service console 105A can then be used to re-establish CLS playgroup 103B without portable CLS stations 108C-108D.

Alternately, portable CLS stations 108A-108D can all be moved to another room (e.g., multi-purpose room 706), and service console 105A can be used to add portable CLS stations 108C and 108D to CLS playgroup 103A (e.g., by dissolving CLS playgroup 103A, and then re-establishing CLS playgroup 103A to include all four portable CLS stations 108A-108D). Again, service console 105A is used to dissolve CLS playgroup 103B prior to establishing this new CLS playgroup, thereby disassociating the portable CLS stations 108C-108D from CLS playgroup 103B. The service console 105A can then be used to re-establish CLS playgroup 103B without portable CLS stations 108C-108D.

In accordance with another embodiment, the portable CLS stations 108A and 108B are occasionally moved from the child's room 704 to the family room 702 to operate as extra channels required for the latest movie audio format. In this case, service console 105A is used to dissolve CLS playgroups 103A and 103B, and then form a new CLS playgroup that includes all of the CLS components previously found in CLS playgroup 103B, plus the portable CLS stations 108A and 108B that were relocated from the child's bedroom.

CLS Playgroup 103C is a legacy system located in the home office 705 to play stereo music. A legacy audio component 115, such as a turntable or a CD player, provides analog audio signals to local control station 110. Local control station 110 operates as a CLS bridge component that performs analog pre-amplification of the received analog audio signals, and performs an analog-to-digital conversion of the amplified analog audio signals, thereby generating a digital audio playback stream. Local control station also performs CLS control station functions, including generating playback executables for use by SPSs 109E-109F, and transmitting the digital audio playback stream to SPSs 109E-109F. Each of the SPSs 109E-109F include an SPS adapter that performs the SPS functions of: receiving the digital audio playback stream, processing the digital audio playback stream in accordance with the specified playback executables to generate digital output samples, and performing digital-to-analog conversion of these digital output samples, thereby producing analog audio output signals. Each of the SPSs 109E-109F also includes a high-power mono-amplifier that receives the analog audio output signals from the SPS adapter, and a high-end loudspeaker that receives (and plays) the amplified analog audio output signals provided by the mono-amplifier.

Although the invention has been described in connection with several embodiments, it is understood that this invention is not limited to the embodiments disclosed, but is capable of various modifications, which would be apparent to a person skilled in the art. Accordingly, the present invention is limited only by the following claims.

I claim:

1. A system comprising:

a system manager coupled to a wireless network through a basic service set (BSS) of the wireless network, wherein the system manager establishes a cognitive loudspeaker system (CLS) network using an independent basic service set (IBSS) of the wireless network;

a first CLS playgroup formed by the system manager through the CLS network IBSS, wherein the system manager assigns a first playgroup identification value to the first CLS playgroup and allocates a first communication channel in the wireless network to the first CLS playgroup, wherein the first CLS playgroup includes a first control station for receiving a first audio playback stream and a first sound production station (SPS) for performing audio playback in response to the first audio playback stream; and a second CLS playgroup formed by the system manager through the CLS network IBBS, wherein the system manager assigns a second playgroup identification value to the second CLS playgroup and allocates a second communication channel in the wireless network to the second CLS playgroup, wherein the second CLS playgroup includes a second control station for receiving a second audio playback stream and a second SPS for performing audio playback in response to the second audio playback stream, wherein the first and second CLS playgroups operate simultaneously.

2. The system of claim 1, further comprising a service console coupled to the system manager through the BSS of the wireless network, wherein the service console provides a user interface to the system manager.

3. The system of claim 1, wherein the wireless network is a WiFi network in accordance with the IEEE 802.11 Standard.

4. The system of claim 1, wherein the system manager specifies an audio channel of the first SPS through the CLS network IBSS.

5. The system of claim 4, wherein the first control station generates a playback executable in response to the specified audio channel of the first SPS, and transmits the playback executable to the first SPS through the CLS network IBSS, wherein the first SPS uses the playback executable to decode the first audio playback stream.

6. The system of claim 1, wherein the first SPS includes a mobility mechanism controlled by the system manager through the CLS network IBSS, wherein the mobility mechanism moves the first SPS.

7. The system of claim 6, wherein the mobility mechanism comprises remotely controlled motorized wheels.

8. The system of claim 6, wherein the mobility mechanism comprises a self-navigation system, which moves the first SPS in response to mapping information and instructions provided by the system manager.

9. The system of claim 1, wherein the system manager includes means for authorizing and associating the first control station, the second control station, the first SPS and the second SPS within the CLS network IBSS.

10. The system of claim 1, wherein the system manager includes means for dissolving the first and second CLS playgroups.

11. The system of claim 1, wherein the system manager includes means for establishing a third CLS playgroup that includes the first control station, the first SPS and the second SPS.

12. A method comprising:

establishing a cognitive loudspeaker system (CLS) network using an independent basic service set (IBSS) of a wireless network;

authorizing and admitting a plurality of CLS components into the CLS network using the IBBS of the wireless network, wherein the plurality of CLS components include a first control station, a first sound production station and a second sound production station;

forming a first CLS playgroup that includes the first control station and the first sound production station, but not the second sound production station, wherein forming the first CLS playgroup comprises assigning a unique playgroup identification value to the first control station and the first sound production station, but not the second sound production station;

dissolving the first CLS playgroup, wherein dissolving the first CLS playgroup comprises:

broadcasting a playgroup dissolution message that includes the playgroup identification value to the plurality of CLS components; and deactivating the first control station and the first sound production station, but not the second sound production station, in response to the playgroup identification value in the playgroup dissolution message; and then forming a second CLS playgroup that includes the first control station, the first sound production station and the second sound production station.

13. The method of claim 12, wherein forming the first CLS playgroup comprises:

assigning an audio channel to the first sound production station; and moving the first sound production station to a location corresponding with the assigned audio channel.

14. The method of claim 13, wherein moving the first sound production station comprises:

transmitting instructions to the first sound production station using the CLS network IBSS; and controlling a mobility mechanism of the first sound production station in response to the transmitted instructions.

15. The method of claim 12, wherein forming the first CLS playgroup comprises:

assigning an audio channel to the first sound production station;

allocating a channel in the wireless network to the first CLS playgroup;

storing the playgroup identification value and the audio channel in the first sound production station;

activating the first sound production station;

storing the playgroup identification value in the first control station; and activating the first control station.

16. The method of claim 12, wherein the plurality of CLS components include a second control station and a third sound production station, the method further comprising forming a second CLS playgroup that includes the second control station and the third sound production station.

17. A method comprising:

establishing a cognitive loudspeaker system (CLS) network using an independent basic service set (IBSS) of a wireless network, wherein the wireless network includes a basic service set (BSS) that provides access to the Internet;

forming a first CLS playgroup in the CLS network IBSS, wherein a first playgroup identification value is assigned to the first CLS playgroup and a first communication channel in the wireless network is allocated to the first CLS playgroup, wherein the first CLS playgroup includes a first control station for receiving a first audio playback stream and a first sound production station (SPS) for performing audio playback in response to the first audio playback stream; and forming a second CLS playgroup in the CLS network IBBS, wherein a second playgroup identification value is assigned to the second CLS playgroup and a second communication channel in the wireless network is allocated to the second CLS playgroup, wherein the second CLS playgroup includes a second control station for receiving a second audio playback stream and a second SPS for performing audio playback in response to the second audio playback stream, wherein the first and second CLS playgroups operate simultaneously.

18. The method of claim 17, further comprising:

dissolving the second CLS playgroup; and then modifying the first CLS playgroup to include the second SPS.

19. The method of claim 17, further comprising:

assigning an audio channel to the first SPS;

generating a playback executable based on the assigned audio channel of the first SPS;

transmitting the playback executable to the first SPS through the CLS network IBSS; and using the playback executable within the first SPS to decode the first audio playback stream.

20. The method of claim 17, further controlling a mobility mechanism of the first SPS through the CLS network IBSS, wherein the mobility mechanism moves the first SPS.

* * * * *